US008219240B2

(12) United States Patent
Iesaki et al.

(10) Patent No.: US 8,219,240 B2
(45) Date of Patent: Jul. 10, 2012

(54) CONVEYANCE DEVICE AND CONVEYANCE METHOD

(75) Inventors: Kenichi Iesaki, Ichinomiya (JP); Kohei Terada, Kiyosu (JP); Tomoaki Hazeyama, Yokkaichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 343 days.

(21) Appl. No.: 12/491,208

(22) Filed: Jun. 24, 2009

(65) Prior Publication Data

US 2009/0322018 A1 Dec. 31, 2009

(30) Foreign Application Priority Data

Jun. 25, 2008 (JP) ..... 2008-165794

(51) Int. Cl.
*B65H 5/00* (2006.01)

(52) U.S. Cl. ..... 700/213; 358/471

(58) Field of Classification Search ..... 700/213, 700/225; 342/174, 165, 81, 92, 26; 477/7, 477/107, 902, 30; 270/30.01, 30.12, 30.13
See application file for complete search history.

(56) References Cited

U.S. PATENT DOCUMENTS 5,894,553 A * 4/1999 Kawazome et al. ..... 709/203
5,896,103 A 4/1999 Bunch
6,796,924 B2 9/2004 Shimizu et al.
2001/0043249 A1* 11/2001 Tabuchi ..... 347/22
2002/0080420 A1* 6/2002 Yokochi ..... 358/471
2006/0114887 A1* 6/2006 Kashimoto ..... 370/352
2009/0219943 A1* 9/2009 Gobara et al. ..... 370/419

FOREIGN PATENT DOCUMENTS

JP H10-123233 A 5/1998
JP 2003-074400 A 3/2003
JP 2008-012789 A 1/2008
JP 2008012789 A * 1/2008

OTHER PUBLICATIONS

Japan Patent Office, Notice of Reason(s) for Rejection for Japanese Patent Application No. 2008-165794 (counterpart to above-captioned patent application), mailed Jul. 27, 2010.

* cited by examiner

*Primary Examiner* — Gene Crawford
*Assistant Examiner* — Kyle Logan
(74) *Attorney, Agent, or Firm* — Baker Botts L.L.P.

(57) ABSTRACT

A conveyance device includes a motor, a conveyance unit, a movement detection signal output unit, a storage unit, a time measurement unit, a first updating unit, a standby time setting unit, a second updating unit, a manipulated variable determination unit, and a motor driving unit. The standby time setting unit sets a value larger than a parameter value TX stored in the storage unit as a standby time TW. The second updating unit updates the parameter value TX stored in the storage unit to the standby time TW each time the elapsed time measured by the time measurement unit reaches the standby time TW.

8 Claims, 6 Drawing Sheets

CONVEYANCE DEVICE AND CONVEYANCE METHOD

CROSS-REFERENCE TO RELATED APPLICATIONS

This application claims the benefit of Japanese Patent Application No. 2008-165794 filed on Jun. 25, 2008 in the Japanese Patent Office, the disclosure of which is incorporated herein by reference.

BACKGROUND

The present invention relates to a technique of conveying an object to be conveyed by a motor.

Conventionally, there are known conveyance devices such as an inkjet printer that conveys a recording sheet or a recording head by a driving force of a motor thereby to form an image on the recording sheet, and a scanner that conveys a line sensor in a sub-scanning direction by a motor thereby to read a document.

In an inkjet printer, for example, there is a limitation in an amount of image that a recording head can form at a time. Therefore, a recording sheet is intermittently conveyed to a recording position and an image is formed in a stepwise manner on the recording sheet, so that the image is formed on the whole recording sheet.

Upon such stepwise recording operation, however, continuity of image cannot be maintained if the recording sheet is not conveyed with high precision. As a result, image quality may be deteriorated. Especially in recent years, a high-resolution image can be recorded on a recording sheet due to advancement in micronization of ink drops. Accordingly, there is also a demand for high precision in a feeding amount of a recording sheet.

In recent-years, a recording sheet is fed by a fixed amount with precision by rotating a motor at a very low speed in a vicinity of a stop position of the recording sheet. At the same time, a conveyance speed of the recording sheet is measured so that a manipulated variable (driving voltage or current) to the motor is determined based on a measurement result.

Particularly, once a leading edge of an encoder signal outputted from an encoder attached to the motor is detected, elapsed time from a previously detected leading edge is specified. The conveyance speed is specified from the elapsed time. The driving voltage or current corresponding to a difference between the conveyance speed and a target speed is then inputted to the motor thereby to drive the motor.

However, in case that the motor is driven in the above-described manner, the leading edge of the encoder signal is not detected when a load is applied to the motor, and an object to be conveyed is abruptly stopped. Then, speed information of the object to be conveyed is not updated. As a result, the difference between the conveyance speed and the target speed is not increased although the object to be conveyed is stopped. The motor is continued to be driven by a low driving voltage or current which is insufficient to move the object to be conveyed. Conveyance of the object to be conveyed may not be able to be restarted.

Such problem occurs not only in an inkjet printer but also in a scanner. Specifically, in the field of scanner, there are more and more demands for high scanning resolution these days. Accordingly, there is a need to convey a line sensor a an extremely low speed. In case that the line sensor is conveyed at an extremely low speed, however, the object to be conveyed (and the motor) is abruptly stopped by a slight load change since a torque of the motor is small. The same problem as in an inkjet printer occurs.

In order to handle such problem, in one prior art, in case that the speed information is not updated within a prescribed period of time, it is determined that a time out has occurred, so as to increase the driving voltage inputted to the motor.

SUMMARY

In the prior art, in case that the speed information is not updated within the prescribed period of time, temporary speed information is set based on the prescribed period of time and a distance between the edges. Also, the next prescribed time is set referring to a table. Thus, a manner of setting the prescribed time is complex. There is also a trouble in design that the table must be created in advance.

In one aspect of the present invention, it would be desirable that normal conveyance control can be restored by easier steps than before even in case that an object to be conveyed is stopped or a speed of the object to be conveyed is significantly decreased due to load change upon low speed conveyance.

A conveyance device in a first aspect of the present invention may include: a motor, a conveyance unit, a movement detection signal output unit, a storage unit, a time measurement unit, a first updating unit, a standby time setting unit, a second updating unit, a manipulated variable determination unit, and a motor driving unit.

The conveyance unit conveys an object to be conveyed by a force generated by the motor. The movement detection signal output unit outputs a movement detection signal each time it is detected that the object to be conveyed has been moved a predetermined distance by conveyance operation of the conveyance unit. The storage unit stores a parameter value TX concerning a cycle of the movement detection signal outputted from the movement detection signal output unit. The time measurement unit measures elapsed time from when the time measurement unit has been reset. The first updating unit updates the parameter value TX stored in the storage unit to the elapsed time measured by the time measurement unit and resets the time measurement unit each time the movement detection signal is outputted from the movement detection signal output unit. The standby time setting unit sets a value larger than the parameter value TX stored in the storage unit as a standby time TW. The second updating unit updates the parameter value TX stored in the storage unit to the standby time TW each time the elapsed time measured by the time measurement unit reaches the standby time TW. The manipulated variable determination unit periodically determines a manipulated variable to the motor based on the parameter value TX stored in the storage unit. The motor driving unit inputs to the motor a driving signal for driving the motor corresponding to the manipulated variable determined by the manipulated variable determination unit.

In the above conveyance device, if a movement detection signal is not outputted from the movement detection signal output unit till the standby time TW arrives, the parameter value TX stored in the storage unit is updated to the standby time TW larger than the previous parameter value TX. Since the measured speed of the object to be conveyed is considered to have reduced due to update of the parameter value TX to the standby time TW, a difference between the target speed and the measured speed of the object to be conveyed is increased. As a result, the motor is controlled so as to reduce the difference (i.e., increase the manipulated variable).

According to the conveyance device, even in case that the object to be conveyed is stopped or the speed of the object to be conveyed is significantly decreased due to load change upon low speed conveyance, normal conveyance control can be restored. An event such that the object to be conveyed, which is stopped due to load change, never starts to move can be inhibited.

Unlike the conventional technique in which the standby time TW is set by referring to a table, it is possible to appropriately set the standby time TW and inhibit the above event from happening without creating the table in advance and storing the table in the conveyance device.

Accordingly, in the present conveyance device, appropriate control can be performed even in a range beyond the range of the table. There is also an advantage in that there is no need for creating the table at designing. Specifically, in a constitution of referring to the table, it is necessary to design the table per the object to be controlled. In the conveyance device of the first aspect, there is no necessity of designing the table. There is an advantage such that development time can be reduced.

In the present conveyance device, there is no necessity of executing troublesome steps of determining whether or not abnormality exists and switching modes in case that abnormality exists. In other words, in the conveyance device of the first aspect, the second update unit is not activated in case that no abnormality is found, or is activated and operates to automatically remove abnormality in case that abnormality is found, depending on the relation between the time measured by the time measurement unit and the standby time TW. Superb functionality can be achieved with a simple constitution.

According to the conveyance device, in case that the object to be conveyed is stopped or the speed of the object to be conveyed is significantly decreased due to load change, normal conveyance control can be restored by easier steps than the prior art in which the table is referred to set timeout time.

Consequently, according to the first aspect of the present invention, the constitution of the control circuit in a conveyance device can be simplified. A high-performance conveyance device that can restore normal conveyance control even in case that the object to be conveyed is stopped or the speed of the object to be conveyed is substantially decreased due to load change upon low speed conveyance can be manufactured at low cost.

A conveyance method in a second aspect of the present invention may include: a conveyance step, a movement detection signal, outputting step, a storing step, a time measuring step, a first updating step, a standby time setting step, a second updating step, a manipulated variable determining step, and a motor driving step.

In the conveyance step, an object to be conveyed is conveyed by a force generated by a motor. In the movement detection signal outputting step, a movement detection signal is outputted each time it is detected that the object to be conveyed has been moved a predetermined distance. In the storing step, a parameter value TX concerning a cycle of the movement detection signal is stored in a pre-reserved storage area. In the time measuring step, a time measurement unit is made to measure elapsed time from when the time measurement unit has been reset. In the first updating step, the parameter value, TX stored in the storage area is updated to the elapsed time and the time measurement unit is reset each time the movement detection signal is outputted. In the standby time setting step, a value larger than the parameter value TX stored in the storage area is set as a standby time TW. In the second updating step, the parameter value TX stored in the storage area is updated to the standby time TW each time the elapsed time measured by the time measurement unit reaches the standby time TW. In the manipulated variable determining step, a manipulated variable to the motor is periodically determined based on the parameter value TX stored in the storage area. In the motor driving step, a driving signal for driving the motor corresponding to the manipulated variable determined in the manipulated variable determining step is inputted to the motor.

Such conveyance method is achieved by the conveyance device of the first aspect. Therefore, according to the conveyance method of the second aspect, the same effect as in the conveyance device of the first aspect can be brought about.

BRIEF DESCRIPTION OF THE DRAWINGS

The invention will now be described below, as an example, with reference to the accompanying drawings in which.

DETAILED DESCRIPTION OF THE PREFERRED EMBODIMENT

Figure 1:
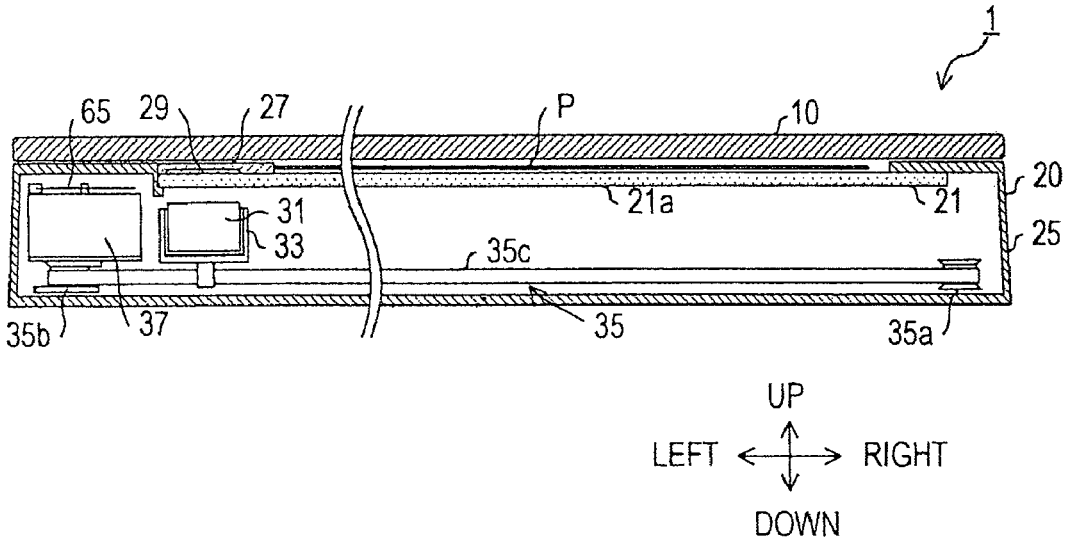
FIG. 1 is a schematic cross sectional view showing an image reading device, according to an embodiment of the present invention, along a sub-scanning direction of a line sensor.

Referring to FIG. 1, an image reading device 1 of the present embodiment is configured as a so-called flatbed scanner including a line sensor 31, a conveyance mechanism of the line sensor 31, and others.

Particularly, the image reading device 1 is constituted from a main cover 10 and a main body 20. The main cover 10 is provided above the main body 20 in an openable and closable manner. In a condition that the main cover 10 is closed, a top surface of the main body 20 is covered by the main cover 10.

The main body 20 includes: a platen glass 21; a case 25 that supports the platen glass 21; a cover member 27; a white reference member 29 provided on a reverse side of the cover member 27; the line sensor 31; a carriage 33 that mounts the line sensor 31 thereon, a belt conveyance mechanism 35; and a motor 37 (direct current motor) that drives the belt conveyance mechanism 35.

The case 25 is formed into a substantially rectangular parallelepiped which is open on the top. The platen glass 21 is provided in the case 25 in such a manner as to close an opening of the case 25. Although details are not given in FIG. 1, the case 25 is configured to support and secure the platen glass 21 to the case 25.

On top of the platen glass 21, the cover member 27 is attached so as to adhere to the top surface of the platen glass 21 through the white reference member 29. The cover member 27 is longitudinal in a main scanning direction of the line sensor 31 (a perpendicular direction with respect to a FIG. 1 drawing, that is, a direction from the front side toward the back side of the FIG. 1 drawing) along a left side edge of the platen glass 21, which is an edge on a home position side of the line sensor 31.

A right edge of the cover member 27 is defined as an abutting position of a document P. On the top surface of the cover member 27, positions on the platen glass 21 to arrange the document P to be read are marked per document size. Specifically, the cover member 27 serves to position the document P to be read on the platen glass 21. Hereinafter, a surface area of the platen glass 21 exposed to the top of the main body 20 without being covered by the cover member 27 or else is referred to as a "placement table" 21*a*. In the present embodiment, the document P to be read is placed on the placement table 21*a*.

The white reference member 29 provided on the reverse side of the cover member 27 is made of a white-colored member having a length corresponding to a length in the main scanning direction of the line sensor 31. The white reference member 29 is disposed along the main scanning direction in such a manner as to face the platen glass 21, and fixed to a specified position on the platen glass 21 by the cover member 27. The white reference member 29 is used for generating correction data necessary to convert information on electric charges accumulated in the line sensor 31 by photoelectric effect into appropriate pixel values.

The line sensor 31 is provided to be movable in a sub-scanning direction (right and left direction in FIG. 1) through the belt conveyance mechanism 35 in an area below the platen glass 21. The line sensor 31 is a known line sensor that is provided with a light-receiving surface having a length nearly equal to a length in the main scanning direction of the placement table 21*a* and reads the document P placed on the platen glass 21 per line.

Particularly, the line sensor 31 includes a plurality of light-receiving elements disposed in ling along the main scanning direction. The line sensor 31 receives reflection of light irradiated to the object to be read on the platen glass 21 from a light source through these light-receiving elements to generate line data which includes pixel data for one line in the main scanning direction. The line sensor 31 is disposed inside the case 25 in a condition mounted on the carriage 33.

The carriage 33 is fixed to a belt 35*c* which winds around a pair of rollers 35*a*, 35*b* provided in the belt conveyance mechanism 35. The carriage 33 is moved in the sub-scanning direction as the belt 35*c* is rotated by power generated by the motor 37. Specifically, the line sensor 31 is conveyed in the sub-scanning direction together with the carriage 33 conveyed by the belt conveyance mechanism 35.

Figure 2:
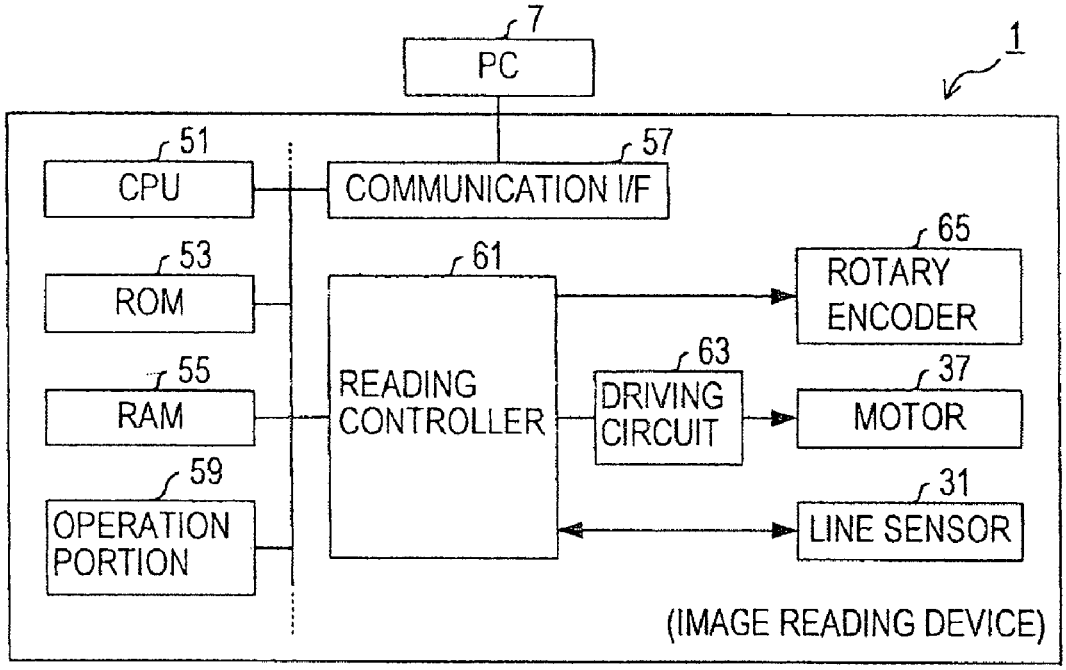
FIG. 2 is a block diagram showing an electric configuration of the image reading device.

As shown in FIG. 2, the image reading device 1 includes a CPU 51, a ROM 53, a RAM 55, a communication interface (I/F) 57, an operation portion 59, a reading controller 61, a driving circuit 63, a rotary encoder 65, the aforementioned line sensor 31 and the aforementioned motor 37.

The CPU 51 integrally controls respective components of the image reading device 1 by executing programs stored in the ROM 53 to achieve a scanning function, etc. The RAM 55 is used as a work area when the CPU 51 executes the programs.

The communication interface 57 is an interface for communication with an external personal computer (PC) 7. The image reading device 1 receives a reading command from the external personal computer 7 or provides read image data generated by the scanning function to the personal computer 7 through the communication interface 57. The operation portion 59 is a user interface for inputting operation information entered through operation switches to the CPU 51.

The reading controller 61 controls the motor 37 and the line sensor 31. The reading controller 61 of the present embodiment drives the motor 37 to move the line sensor 31 in the sub-scanning direction, as well as makes the line sensor 31 execute reading operation per line during the move of the line sensor 31 so as to read the document P placed on the placement table 21*a*.

The driving circuit 63 drives the motor 37 by a driving signal (driving voltage or a driving current) corresponding to a manipulated variable u inputted from the reading controller 61. In the present embodiment, the driving signal corresponding to the manipulated variable u is inputted to the motor 37 by PWM control. Accordingly, the magnitude of the driving signal corresponds to a duty ratio of the driving signal.

Figure 3:
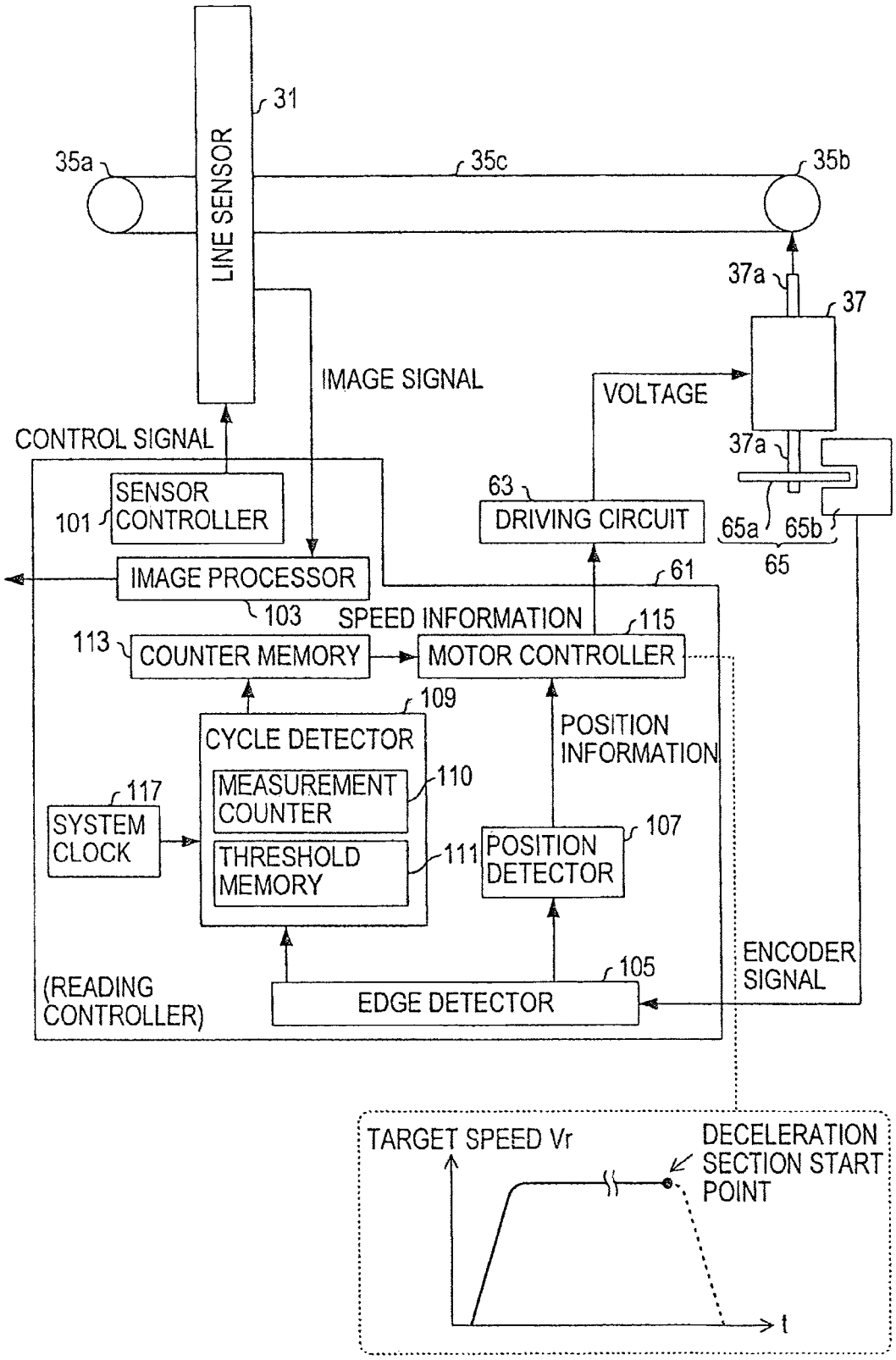
FIG. 3 is a block diagram showing a detailed configuration of a reading controller of the image reading device.

As shown in FIG. 3, the rotary encoder 65 is a known incremental rotary encoder having two-phase output. The rotary encoder 65 includes an encoder scale 65*a* and a sensor body 65*b*. The encoder scale 65*a* is constituted from a slit circular disk (that has slit patterns formed at predetermined angle intervals) fixed to a driving shaft 37*a* of the motor 37.

The motor shaft 37*a* vertically protrudes from the motor 37. A pinion (not shown) is attached to one end of the driving shaft 37*a*, and the encoder scale 65*a* is attached to the other end of the driving shaft 37*a*. The pinion is connected to a not shown gear leading to the roller 35*b*. A rotational force of the motor 37 is transmitted to the roller 35*b* through the not shown gear.

The sensor body 65*b* constituting the rotary encoder 65 includes two pairs of a phototransistor and a light-emitting diode for detecting the slit pattern of the encoder scale 65*a*. The encoder scale 65*a* is interposed between the phototransistors and the light-emitting diodes.

In the sensor body 65*b*, the two pairs of the phototransistor and the light-emitting diode are arranged a predetermined distance apart in a rotation direction of the encoder scale 65*a*. From the sensor body 65*b*, an A-phase signal and a B-phase signal having a phase difference of 90 degrees are outputted as encoder signals. Particularly, depending on receipt/non-receipt of light outputted from the light-emitting diode at the phototransistor due to rotation of the encoder scale 65*a*, pulse signals as the encoder signals are outputted each time the motor 37 rotates a predetermined amount (i.e., each time the line sensor 31 travels a predetermined distance).

The encoder signals outputted from the rotary encoder 65 (the A-phase signal and the B-phase signal) are inputted to the reading controller 61 to be utilized for feedback control of the motor 37.

The reading controller 61 includes a sensor controller 101, an image processor 103, an edge detector 105, a position detector 107, a cycle detector 109, a counter memory 113, a motor controller 115, and a system clock 117.

The sensor controller 101 controls reading operation of the line sensor 31. At regular time intervals, the sensor controller 101 transfer the accumulated electric charges in the light-receiving elements to a shift register inside the line sensor 31. At the same time, the sensor controller 101 resets the light-receiving element by the transferring operation and makes the light-receiving elements execute next reading operation. Then, the sensor controller 101 makes the line sensor 31 output electric charge information transferred to the shift register as the aforementioned line data before completion of the next reading operation. The line data outputted from the line sensor 31 is inputted to the image processor 103.

The image processor 103 sequentially converts analog line data inputted from the line sensor 31 in the above described manner into digital data. The converted line data is inputted to the CPU 51.

The edge detector 105 detects at least one of leading edges and trailing edges of the encoder signals (the A-phase signal and the B-phase signal) inputted from the rotary encoder 65 and inputs edge detection signals to the position detector 107 and the cycle detector 109. In the present embodiment, the edge detector 105 detects the leading edges of the A-phase signal and, at timings of the leading edges of the A-phase signal, outputs the edge detection signals. The edge detector 105 also detects a rotation direction of the encoder scale 65*a* (i.e., a traveling direction of the line sensor 31) from the phase difference between the A-phase signal and the B-phase signal, and inputs a signal indicating the rotation direction to the position detector 107 and the cycle detector 109.

The position detector 107 specifies a position coordinate of the line sensor 31 based on the edge detection signal and the signal indicating the rotation direction inputted from the edge detector 105.

Particularly, the position coordinate of the line sensor 31 which moves in conjunction with the rotation of the motor 37 is specified as follows. When the edge detection signal is inputted as the encoder scale 65*a* is rotated forward, a counter value X indicating the position coordinate of the line sensor 31 is incremented by 1 ($X \leftarrow X+1$). When the edge detection signal is inputted as the encoder scale 65*a* is rotated backward, the counter value X is decremented by 1 ($X \leftarrow X-1$). The counter value X held in the position detector 107 is inputted to the motor controller 115.

Figure 4:
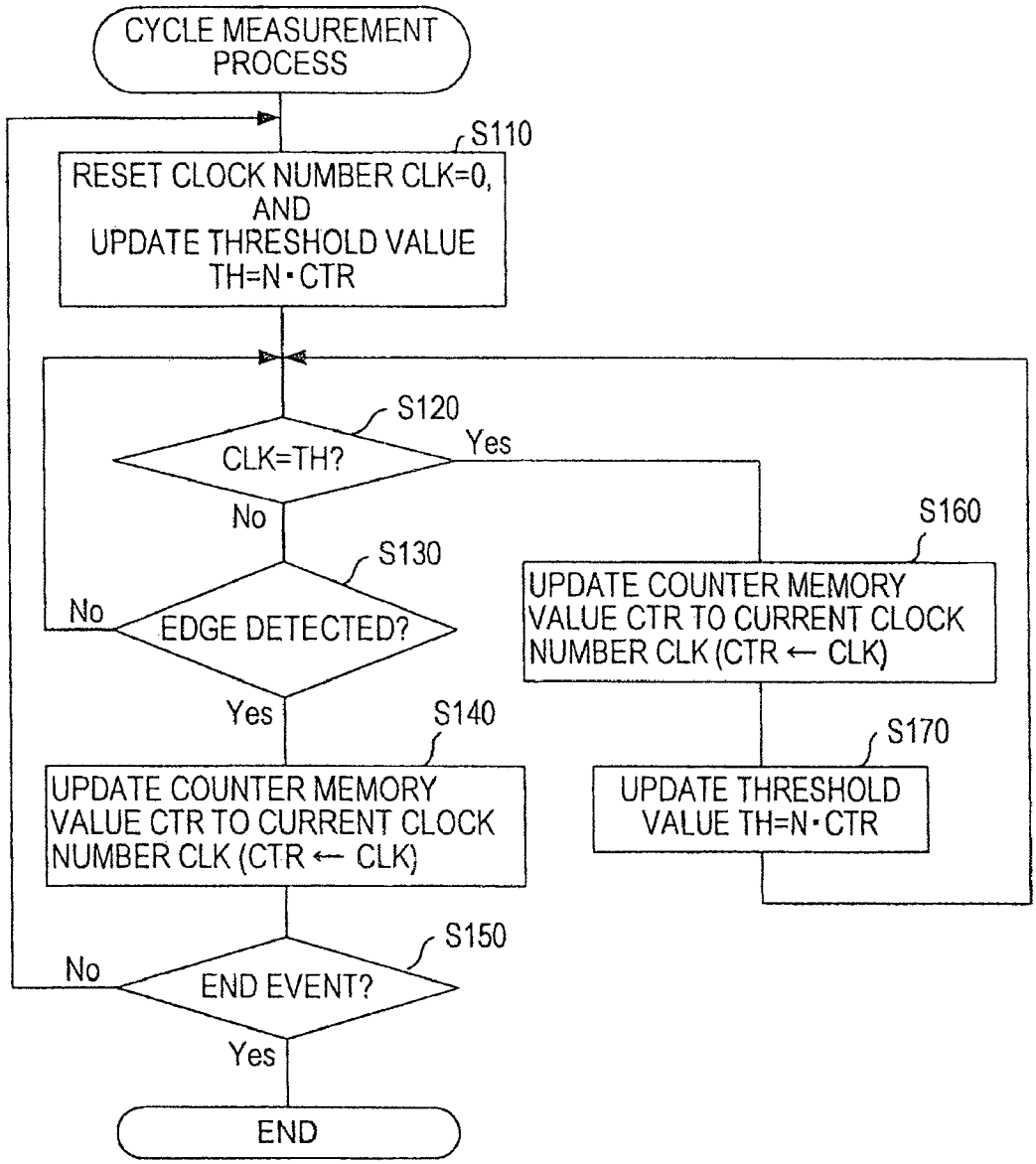
FIG. 4 is a flow chart illustrating a cycle measurement process executed by a cycle detector of the image reading device.

The cycle detector 109 executes a process shown in FIG. 4 to measure elapsed time from when the edge detection signal is inputted. Based on a measurement result, a cycle determination value CTR indicating an input cycle of the edge detection signal stored in the counter memory 13 is updated (details will be described later). Particularly, the cycle detector 109 includes a measurement counter 110 and a threshold memory 111. The measurement counter 110 measures time based on clock signals inputted from the system clock 117. The threshold memory 111 stores a later-described threshold TH in the form of a bit string which includes a series of bits.

The counter memory 113 stores the cycle determination value CTR indicating the input cycle of the edge detection signal as described in the above. The cycle determination value CTR is inputted to the motor controller 115. The counter memory 113 stores the cycle determination value CTR in the form of a bit string which includes a series of bits.

The motor controller 115 performs speed control of the motor 37, (and the line sensor 31) based on the cycle determination value CTR inputted from the counter memory 113 and the counter value X inputted from the position detector 107.

Particularly, the motor controller 115 assumes a reciprocal of the cycle determination value CTR as a conveyance speed (traveling speed) V of the line sensor 31 to thereby calculate a deviation e from a target speed Vr predesignated by the CPU 51 ($e=Vr-V$). By inputting the deviation e to a given transfer function, the manipulated variable u to the motor 37 is figured out. By this transfer function, a value which reduces an absolute value of the deviation e (which converges an absolute value of the deviation e into zero (0)) is calculated as the manipulated variable u.

The motor controller 115 performs speed control by inputting the calculated manipulated variable u to the driving circuit 63 and making the driving circuit 63 drive the motor 37 with a driving signal corresponding to the manipulated variable u, so that the line sensor 31 travels at a speed corresponding to the target speed Vr.

The manipulated variable u is calculated at a specified control cycle Ts. Specifically, the motor controller 115 calculates the manipulated variable u in the above described manner per the control cycle Ts based on the cycle determination value CTR held in the counter memory 113 at that time and the target speed Vr specified by the CPU 51 at that time. The calculated manipulated variable u is inputted to the driving circuit 63. To the motor controller 115, the target speed Vr corresponding to each of acceleration, constant speed, deceleration sections as shown in a lower part of FIG. 3 as an example is specified by the CPU 51. A starting point of the deceleration section is determined based on the counter value X inputted from the position detector 107.

When the target speed Vr is very low, a problem such that the line sensor 31 (the motor 37) abruptly stops due to load change in a conveyance path is easy to occur.

Accordingly, in case that it is necessary to convey the line sensor 31 at a very low speed, such as in the case of reading an object to be read at a high resolution, rotation of the motor 37 is stopped due to abrupt load change even if the cycle determination value CTR is updated as before each time the edge detection signal is inputted. As a result, when the edge detection signal is not inputted, feedback control does not appropriately work because the cycle determination value CTR is not updated. The line sensor 31 may remain stopped and be never started to move.

In the present embodiment, such an event is avoided by executing a cycle measurement process shown in FIG. 4 in the cycle detector 109. Details of the cycle measurement process will be described hereinafter. The cycle detector 109 starts the cycle measurement process once the cycle detector 109 is started.

When the cycle measurement process is started, the cycle detector 109 first resets a clock number CLK held in the built-in measurement counter 110 to zero (0) thereby to make the measurement counter 110 start count operation of the clock number CLK from zero (0) (S110). The measurement counter 110 increments the clock number CLK each time a clock signal is inputted from the system clock 117.

When the clock number CLK is reset, a threshold TH in the built-in threshold memory 111 is set to a N multiple of the cycle determination value CTR held in the counter memory 113 ($TH \leftarrow N \cdot CTR$). A constant N may be set as a value larger than 1, for example, as a value 2 ($N=2$).

Figure 5:
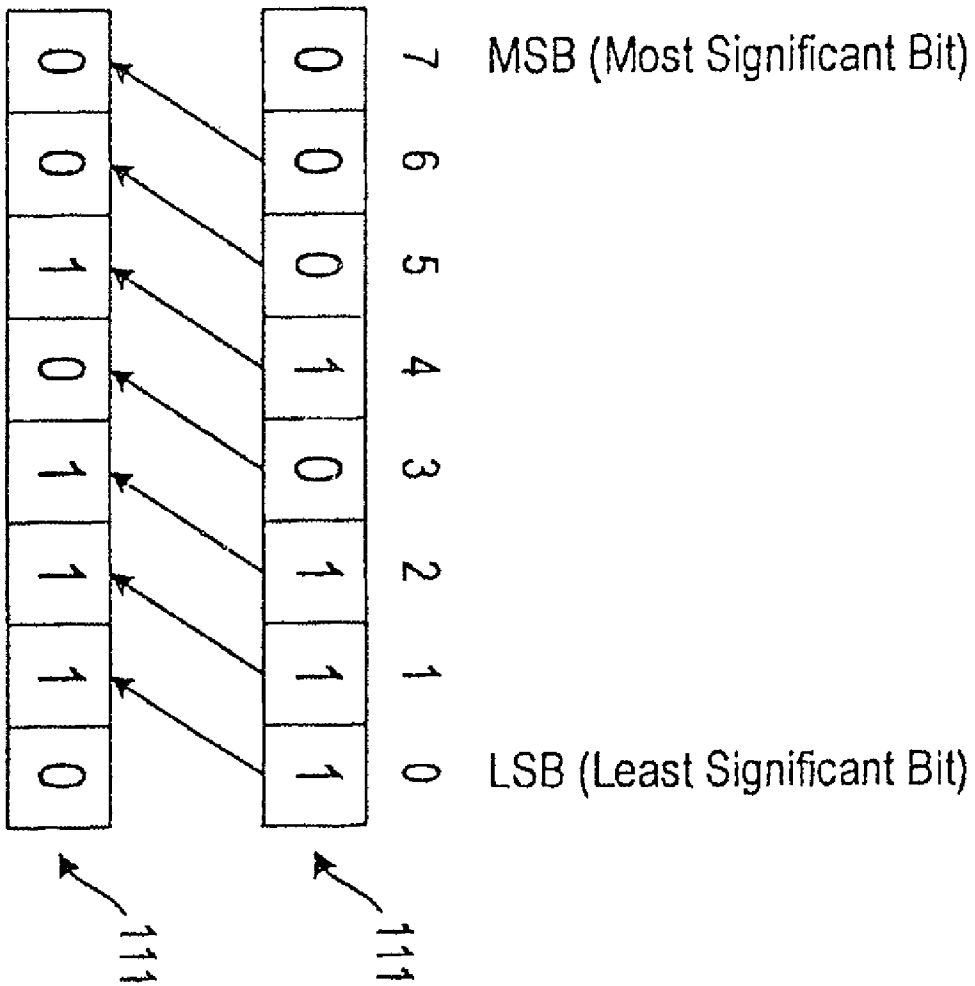
FIG. 5 is an explanatory view schematically showing an example of an update process of a threshold.

In case that the constant $N=2$, the cycle detector 109 may update the threshold TH by making the threshold memory 111 store the cycle determination value CTR and then shifting bits of the cycle determination value CTR (bit shift operation; see FIG. 5). Thereby, the threshold. TH which is a doubled determination value CTR is set to the threshold memory 111.

The cycle detector 109, then stands by until the clock number CLK counted by the measurement counter 110 reaches the threshold TH or the edge detection signal is inputted from the edge detector 105 (S120, S130). When the edge detection signal is inputted (S130: Yes), the clock number CLK held in the measurement counter 110 at that point is inputted to the counter memory 113 thereby to update the cycle determination value CTR held in the counter memory 113 to the clock number CLK at the time when the edge detection signal is inputted (S140).

If no end event occurs at this point (S150: No), the process moves to S110. The clock number CLK counted by the measurement counter 110 is reset to zero (0) and the measurement counter 110 is made to newly start the count operation of the clock number CLK. Succeeding steps are carried out thereafter. Examples of the end events include a power-off event of the image reading device 1.

In the above described manner, the cycle detector 109 resets the measurement counter 110 each time the edge detection signal is inputted, thereby to make the measurement counter 110 measure elapsed time from when the edge detection signal is inputted. Also, the clock number CLK indicating the elapsed time until that time measured by the measurement counter 110 is inputted to the counter memory 113 each time the edge detection signal is inputted, thereby to update the cycle determination value CTR held in the counter memory 113 to the clock number CLK.

If the edge detection signal is not inputted for a time corresponding to the threshold TH and when the clock number CLK counted by the measurement counter 110 reaches the threshold TH (S120: Yes), the cycle detector 109 inputs the clock number CLK held in the measurement counter 110 at the point to the counter memory 113 thereby to update the cycle determination value CTR held in the counter memory 113 to the clock number CLK at that point (S160). In other words, the cycle determination value CTR held in the counter memory 113 is updated to the threshold TH at that point (S160).

Thereafter, in the same manner as in S110, the cycle detector 109 updates the threshold TH to a N-multiple of the cycle determination value CTR after the above described updating held in the counter memory 113 (S170), i.e., TH=N·CTR.

Subsequently, the cycle detector 109 stands by until the clock number CLK counted by the measurement counter 110 reaches the newly. % set threshold TH or the edge detection signal is inputted from the edge detector 105 (S120, S130). When the edge detection signal is inputted (S130: Yes), the above described steps of S140 and onwards are carried out. When the clock number CLK reaches the threshold TH (S120: Yes), the steps of S160 and onwards are carried out.

Specifically, in case that a period continues during which the edge detection signal is not inputted, the cycle detector 109 updates the threshold TH to N·CTR0, N2·CTR0, N3·CTR0, N4·CTR0, . . . , where CTR0 is the cycle determination value CTR after updated at the time when the edge detection signal is lastly inputted. At the same time, the cycle determination value CTR of the counter memory 113 is also updated to CTR0, N·CTR0, N2·CTR0, N3·CTR0, . . . .

According to the above described operation of the cycle detector 109, the conveyance speed V of the line sensor 31 expressed by the reciprocal of the cycle determination value CTR is gradually getting low and the deviation e from the target speed Vr is gradually getting large. As a result, by the above described operation of the cycle detector 109, the motor 37 which has abruptly stopped due to load change overcomes the load and starts to rotate again.

When the end event occurs (S150: Yes), the cycle detector 109 ends the cycle measurement process.

Particular explanation will now be given on a determination manner of the manipulated variable u according to the present invention. In the above embodiment, the conveyance device of the present invention is applied to the image reading device 1. However, the present invention can be applied to conveyance control of a recording head and a recording sheet of an inkjet printer, and so on.

Figure 6:
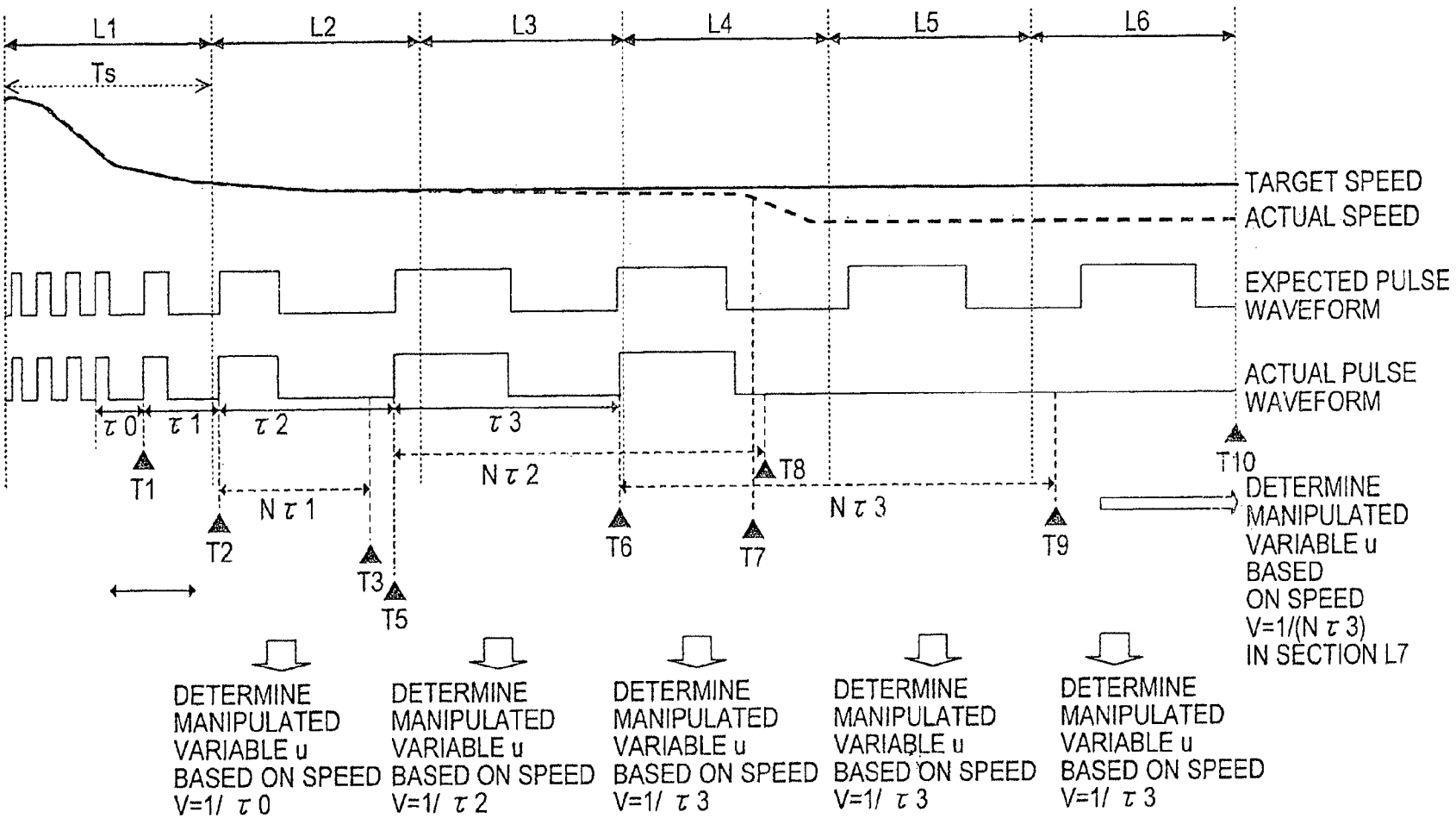
FIG. 6 is a time chart showing an example of determination manners of a manipulated variable u.

Referring to FIG. 6, a determination manner of the manipulated variable u is explained in case that the present invention is applied not just to an image reading device but to an ordinary conveyance device. In FIG. 6, conveyance control of a recording sheet in an inkjet printer is assumed.

In the example shown in FIG. 6, each of sections L1-L6 respectively corresponds to the control cycle Ts. In the motor controller 115, the manipulated variable u is determined in the above described manner based on the latest cycle determination value CTR at the time at a start point of each of the sections L1-L6.

Particularly, at the start point of the section L2, the cycle determination value CTR=τ0 which is updated at time T1 of the section L1 is the latest cycle determination value. Thus, in the section L2, the speed of the object to be conveyed is assumed as V=1/τ0 and the manipulated variable u is calculated.

In the section L2, since the edge detection signal is inputted at time T2, the cycle determination value is updated to CTR=τ1 and the threshold is updated to TH=N·τ1 at the time T2. Time T5 when the next edge detection signal is inputted is later than time T3 when the time N·τ1 corresponding to the threshold TH elapses from the time T2. Therefore, the cycle determination value is updated to CTR=N·τ1 at the time T3 although the edge detection signal is not inputted. The threshold TH is updated to N2·τ1.

At the time T5 when the edge detection signal is inputted, the cycle determination value CTR is updated to a value τ2 (CTR=τ2) which corresponds to elapsed time from when the edge detection signal is previously inputted (time T2). The threshold is updated to TH=N·τ2.

In the example shown in FIG. 6, the cycle determination value CTR is updated as above. At the start point of the section L3, since the cycle determination value CTR=τ2 updated at the time T5 of the section L2 is the latest cycle determination value, the speed of the object to be conveyed is assumed as V=1/τ2 in the section L3 and the manipulated variable u is calculated.

Also in the example shown in FIG. 6, time T6 when the next edge detection signal is inputted is earlier than time T8 when the time N·τ2 corresponding to the threshold TH elapses from the time T5. Thus, the clock number CLK of the measurement counter 110 never reaches the threshold TH=N·τ2. When the time T6 arrives, the clock number CLK is reset. At the same time, at the time T6, the cycle determination value CTR is updated to a value τ3 (CTR=τ3) corresponding to elapsed time from when the edge detection signal is previously inputted (time T5). The threshold TH is updated to N·τ3.

At a start point of the section L4, the cycle determination value CTR=τ3 updated at the time T6 of the section L3 is the latest cycle determination value. In the section L4, the speed of the object to be conveyed is assumed as V=1/τ3 and the manipulated variable u is calculated.

In the example shown in FIG. 6, abrupt load change occurs at time T7 of the section L4. An actual speed of the object to be conveyed is abruptly reduced from the target speed Vr. For example, the actual speed of the object to be conveyed becomes zero (0) to stop the object to be conveyed.

In this case, an expected pulse waveform is not obtained from the rotary encoder 65. Leading edges of the encoder signal are not detected. The motor 37 never overcomes the load and the object to be conveyed remains stopped if no measures are taken as before.

In the present embodiment, the process shown in FIG. 4 is performed in the cycle detector 109. Accordingly, after the following steps, the magnitude of the driving signal of the motor 37 is gradually increased. Thereby, the motor 37 overcomes the load and the object to be conveyed is started to move.

Particularly, in the section L4, the edge detection signal is not inputted and the clock number CLK of the measurement counter 110 never reaches the threshold TH. Thus, the cycle determination value CTR held in the counter memory 113 remains updated at the time T6.

In the section L5, the speed of the object to be conveyed is assumed as V=1/τ3 and the manipulated variable u is calculated. In the section L5 as well as in the section L4, the edge detection signal is not inputted and the clock number CLK of the measurement counter 110 never reaches the threshold TH. Thus, the cycle determination value CTR held in the counter memory 113 remains updated at the time T6.

In the section L6 as well as in the section L5, the speed of the object to be conveyed is assumed as $V=1/\tau 3$ and the manipulated variable u is calculated. Accordingly, the motor 37 never overcomes the load at this point. The object to be conveyed remains stopped.

In the section L6, the clock number CLK of the measurement counter 110 reaches the threshold $TH=N\cdot\tau 3$ at time T9. Thus, although the edge detection signal is not inputted, the cycle determination value CTR is updated to $N\cdot\tau 3$ at time T9. The threshold TH is updated to $N2\cdot\tau 3$.

Consequently, at a start point of the section L7 (time T10) following the section L6, the cycle determination value $CTR=N\cdot\tau 3$ updated at the time T9 of the section L6 is the latest cycle determination value. In the section L7, the speed of the object to be conveyed is assumed as $V=1/(N\cdot\tau 3)$ and the manipulated variable u is calculated.

Specifically, in the section L7, the deviation e is increased and the magnitude of the driving signal to the motor 37 is increased. If the load applied to the motor 37 is small, a torque of the motor 37 overcomes the load at this point. The object to be conveyed that has been stopped is started to move.

Even if the load is large and the object to be conveyed is not started to move at the time T10, the cycle determination value CTR is gradually increased to $N2\cdot\tau 3$, $N3\cdot\tau 3$, $N4\cdot\tau 3$, . . . as time elapses. Together with the increase in the cycle determination value CTR, the deviation e is increased and the magnitude of the driving signal inputted to the motor 37 is gradually increased. Therefore, the motor 37 eventually overcomes the load and starts to rotate so that the object to be conveyed is started to move.

According to the present embodiment, when the object to be conveyed (such as the line sensor 31) is conveyed at a low speed, the magnitude of the driving signal to the motor 37 can be gradually increased even if the object to be conveyed may be stopped due to load change. An abnormal stopped state of the object to be conveyed due to load change can be cleared.

According to the present embodiment, an extremely simple control circuit can clear the stopped state of the object to be conveyed due to load change. Thus, a fine product can be produced at low cost.

Specifically, according to the present embodiment, it is not necessary to refer to a table upon setting the threshold TH as before. Also, it is not necessary to figure out more appropriate threshold TH in advance by experiments and the like and create a table for switching control using the threshold TH.

In the present embodiment if there is no unexpected speed reduction (abrupt speed reduction or stop of the object to be conveyed, for example), the value CTR of the counter memory 113 is updated by input of the edge detection signal before the control cycle arrives and ordinary control is not affected (such as in the sections L2-L3) even if it is determined that the clock number CLK has reached the threshold TH (Yes in S120). Only if there is unexpected speed reduction and it is determined that the clock number CLK has reached the threshold TH (Yes in S120), a function that reinstates control to a state of original purpose works (such as in the section L7). The process shown in FIG. 4 can be executed on a steady basis. There is no need to switch control mode by determining the present state between a normal state and an abnormal state as before and by determining whether the present state is in a deceleration, acceleration or constant speed state.

According to the present embodiment, even if the object to be conveyed is stopped due to load change at low speed conveyance or the speed of the object to be conveyed becomes remarkably low, a normal control state can be reinstated by process steps easier than before.

According to the present embodiment, the threshold TH can be figured out by extremely simple calculation. The control circuit can be configured extremely simple. For example, if the constant N is set to 2, resetting of the threshold TH when the clock number CLK exceeds the threshold TH can be achieved by bit shift operation to the previous threshold value TH.

The present invention should not be limited to the above-described embodiment, but may be embodied in various forms. For example, the above embodiment describes an example to which the present invention is applied to the image reading device 1. However, the present invention can be applied to various conveyance devices such as an inkjet printer and so on as described above.

The conveyance device (image reading device 1) may be configured such that the threshold TH is not updated to an N multiple of the cycle determination value CTR but to a value obtained by adding a predetermined value C (C is a positive constant) to the cycle determination value CTR (TH=CTR+C) in S110 and S170.

The threshold TH can be defined by a monotonically increasing function f(CTR) (i.e., TH=f(CTR)) which has the cycle determination value CTR as an input variable and satisfies a condition f(CTR)>CTR. Depending on the adopted function f(CTR), calculation may be complicated. Therefore, it is effective to set the threshold TH by a function as simple as possible from an aspect of manufacturing costs of the product.

What is claimed is:

1. A conveyance device comprising:

a motor;

a conveyance unit that conveys an object to be conveyed by a force generated by the motor;

a movement detection signal output unit that outputs a movement detection signal each time it is detected that the object to be conveyed has moved a predetermined distance by conveyance operation of the conveyance unit;

a storage unit that stores a parameter value TX concerning a cycle of the movement detection signal outputted from the movement detection signal output unit;

a time measurement unit that measures elapsed time from when the time measurement unit has been reset;

a first updating unit that updates the parameter value TX stored in the storage unit to the elapsed time measured by the time measurement unit and resets the time measurement unit each time the movement detection signal is outputted from the movement detection signal output unit;

a standby time setting unit that sets a value larger than the parameter value TX stored in the storage unit as a standby time TW;

a second updating unit that updates the parameter value TX stored in the storage unit to the standby time TW each time the elapsed time measured by the time measurement unit reaches the standby time TW;

a manipulated variable determination unit that periodically determines a manipulated variable to the motor based on the parameter value TX stored in the storage unit; and a motor driving unit that inputs to the motor a driving signal for driving the motor corresponding to the manipulated variable determined by the manipulated variable determination unit, wherein the standby time setting unit sets to the standby time TW a value of a specified monotonically increasing function f(TX), which has the parameter value TX as an input variable, and the monotonically increasing function f(TX) satisfies a condition f(TX)>TX.

2. The conveyance device as set forth in claim 1, wherein the standby time setting unit calculates the standby time TW by multiplying the parameter value TX with a numerical value larger than one.

3. The conveyance device as set forth in claim 1, wherein the standby time setting unit calculates the standby time TW by doubling the parameter value TX.

4. The conveyance device as set forth in claim 1, wherein the standby time setting unit calculates the standby time TW by adding a predetermined positive value to the parameter value TX.

5. A conveyance method comprising:

a conveyance step of conveying an object to be conveyed by a force generated by a motor;

a movement detection signal outputting step of outputting a movement detection signal each time it is detected that the object to be conveyed has been moved a predetermined distance;

a storing step of storing a parameter value TX concerning a cycle of the movement detection signal in a pre-reserved storage area;

a time measuring step of making a time measurement unit measure elapsed time from when the time measurement unit has been reset;

a first updating step of updating the parameter value TX stored in the storage area to the elapsed time and resetting the time measurement unit each time the movement detection signal is outputted;

a standby time setting step of setting a value larger than the parameter value TX stored in the storage area as a standby time TW;

a second updating step of updating the parameter value TX stored in the storage area to the standby time TW each time the elapsed time measured by the time measurement unit reaches the standby time TW;

a manipulated variable determining step of periodically determining a manipulated variable to the motor based on the parameter value TX stored in the storage area; and a motor driving step of inputting a driving signal for driving the motor corresponding to the manipulated variable determined in the manipulated variable determining step to the motor, wherein a value of a specified monotonically increasing function f(TX), which has the parameter value TX as an input variable, is set to the standby time TW in the standby time setting step, and the monotonically increasing function f(TX) satisfies a condition f(TX)>TX.

6. The conveyance method as set forth in claim 5, wherein the standby time TW is calculated by multiplying the parameter value TX with a numerical value larger than one in the standby time setting step.

7. The conveyance method as set forth in claim 5, wherein the standby time TW is calculated by doubling the parameter value TX in the standby time setting step.

8. The conveyance method as set forth in claim 5, wherein the standby time TW is calculated by adding a predetermined positive value to the parameter value TX in the standby time setting step.

* * * * *